US009574521B2

(12) United States Patent
Krup

(10) Patent No.: US 9,574,521 B2
(45) Date of Patent: Feb. 21, 2017

(54) FUEL BOWL AND METHOD OF FEEDING FUEL

(71) Applicant: William R. Krup, Mt. Carmel, IL (US)

(72) Inventor: William R. Krup, Mt. Carmel, IL (US)

( * ) Notice: Subject to any disclaimer, the term of this patent is extended or adjusted under 35 U.S.C. 154(b) by 167 days.

(21) Appl. No.: 14/560,934

(22) Filed: Dec. 4, 2014

(65) Prior Publication Data

US 2015/0152813 A1 Jun. 4, 2015

Related U.S. Application Data

(60) Provisional application No. 61/911,876, filed on Dec. 4, 2013.

(51) Int. Cl.

| | |
|---|---|
| ***F02M 17/02*** | (2006.01) |
| ***F02M 37/02*** | (2006.01) |
| ***F02M 17/06*** | (2006.01) |

(52) U.S. Cl.

CPC ..... *F02M 17/02* (2013.01); *F02M 17/06* (2013.01); *F02M 37/02* (2013.01); *F02M 37/025* (2013.01); *Y10T 137/0318* (2015.04)

(58) Field of Classification Search

CPC ..... F02M 17/02; F02M 17/06; F02M 37/00; F02M 37/02; F02M 37/025

USPC ..... 261/34.1, 34.2, 36.1, 36.2, 72.1

See application file for complete search history.

(56) References Cited

U.S. PATENT DOCUMENTS 4,168,289 A * 9/1979 Saunion ..... F02M 17/06 261/36.2

* cited by examiner

*Primary Examiner* — Robert A Hopkins

(74) *Attorney, Agent, or Firm* — Senniger Powers LLP

(57) ABSTRACT

A fuel bowl for a carburetor has no valves and is configured for continuous flow of fuel through the bowl. The fuel bowl can be constructed to constrain the constantly flowing fuel within a compartment of the bowl to maintain fuel level in the bowl sufficient to meet the carburetor demand under circumstances of high fuel demand and/or high g-forces. A method of continuously circulating fuel through the fuel bowl facilitates fuel level maintenance over a range of performance requirements.

18 Claims, 10 Drawing Sheets

FUEL BOWL AND METHOD OF FEEDING FUEL

CROSS REFERENCE TO RELATED APPLICATION

This application is a nonprovisional and continuation-in-part of U.S. Patent Application No. 61/911,876, titled CARBURETOR HAVING CONSTANT FLOW FUEL BOWL, which was filed on Dec. 4, 2013 and which is incorporated herein by reference in its entirety for all purposes.

BACKGROUND

The present invention relates generally to carburetors for gasoline engines and more particularly to fuel bowls for carburetors and methods of feeding fuel to carburetors.

Carburetors used to supply a fuel/air mix to internal combustion engines rely on a fuel bowl to hold liquid fuel (e.g., gasoline) to be drawn into the carburetor. High-performance engines, such as those used in automobile racing, may put extraordinary demands on the carburetor. Carburetors typically include a main body through which a stream of air from the air intake passes to the manifold, and in which gasoline is fed into the air stream. A fuel bowl holding a reservoir of gasoline is mounted on the main body by a meter block through which a measured flow of gasoline is aspirated from the fuel bowl to the air stream in the main body. One face of the meter block forms a wall of the fuel bowl which is usually immersed about halfway up the face in the gasoline in the fuel bowl. Fuel supply ports in the meter block are positioned to be covered by the gasoline in the fuel bowl so that liquid fuel can be drawn into the meter block and carburetor as needed. It will be understood that there are times when additional liquid fuel will be needed in the fuel bowl and other times when little or no additional fuel is required. Accordingly, fuel bowls typically rely on a float valve to control the level of gasoline in the bowl. As the fuel bowl fills with gasoline, the buoyancy of the float valve causes it to rise on the gasoline until it block a fuel inlet into the fuel bowl. When the level of gasoline drops in the fuel bowl as gasoline is drawn into the carburetor, the float valve moves off the fuel inlet allowing additional gasoline to flow into the fuel bowl.

Upon acceleration in high-performance engines such as those found in automobile racing, immediate and high demand for liquid from the fuel bowl may occur. Conventionally, fuel bowls have relied upon float valves to replenish fuel in the fuel bowl as it is drawn off by carburetor. Valves in general and float valves in particular have finite reaction times, so that there is a small but measureable delay between the rapid intake of gasoline by the carburetor and the flow of replenishing gasoline into the fuel bowl. Moreover, the flow of fuel must go from zero to full flow as the valve opens, which requires some time. In high-performance engines, the delays may be such that there can be a period in which the gasoline level in the fuel bowl falls to a level below that of the fuel supply outlet into the carburetor. As a result, the engine may be starved for fuel for a few moments until the gasoline level in the fuel bowl rises to cover the carburetor fuel supply outlet, producing a significant reduction in engine performance. Starving the engine for fuel can damage the engine. Rapid onset of gasoline flow (i.e., from zero to maximum flow) has been found to produce foaming of the gasoline. If foam is covering the fuel supply outlet to the carburetor, it receives a mixture of gasoline and air rather than solely liquid gasoline. This can also reduce the performance of the engine.

In addition to issues that may be raised by high fuel demand, inertia of the fuel can cause the carburetor and hence the engine to be starved for fuel in situations where the racing automobile experiences significant acceleration. For example as the automobile corners at high speed, substantial acceleration is developed because of the change in direction of the automobile. The inertia of the gasoline in the fuel bowl causes the fuel to move to one side of the bowl in this situation. Often the fuel bowl has two fuel supply outlets to the carburetor, one for each side of the engine. Movement of the fuel to one side of the bowl may uncover one of the fuel supply outlets, causing one side of the engine to be starved for fuel. Conceivably, both fuel supply outlets from the fuel bowl may be uncovered. Reaction of the float valve to this circumstance involves delay and it cannot prevent one or both of the fuel supply outlets from becoming uncovered so no gasoline is delivered to the carburetor.

SUMMARY

In one aspect, a fuel bowl for holding liquid fuel to be fed into a carburetor for an internal combustion engine includes a body having an internal cavity. A fuel inlet is configured to receive fuel from a fuel tank into the cavity. A recirculation outlet is configured to pass fuel from the internal cavity back to the fuel tank. A fuel supply outlet is configured for mating with a carburetor fuel inlet for passing liquid fuel from the cavity to the carburetor. The body is free of valving, whereby fuel can be circulated continuously through the cavity.

In another aspect, a fuel bowl for holding liquid fuel to be fed into a carburetor for an internal combustion engine includes a body having an internal cavity. A fuel inlet is configured to receive fuel from a fuel tank into the cavity. A recirculation outlet is configured to pass fuel from the internal cavity back to the fuel tank. A fuel supply outlet is configured for mating with a carburetor fuel inlet for passing liquid fuel from the cavity to the carburetor. A flow restrictor in the cavity is arranged between the fuel supply outlet and the recirculation outlet for retaining fuel in a volume including the fuel supply outlet.

In yet another aspect, a method of feeding liquid fuel to a carburetor of an internal combustion engine includes continuously circulating liquid fuel through a fuel bowl. The fuel is constrained within the fuel bowl to maintain a volume of fuel in a reservoir compartment of the fuel bowl including a fuel supply outlet connected to the carburetor through which liquid fuel from the fuel bowl is drawn into the carburetor.

BRIEF DESCRIPTION OF DRAWINGS

Corresponding reference characters indicate corresponding parts throughout the several views of the drawings.

DETAILED DESCRIPTION

Figure 1:
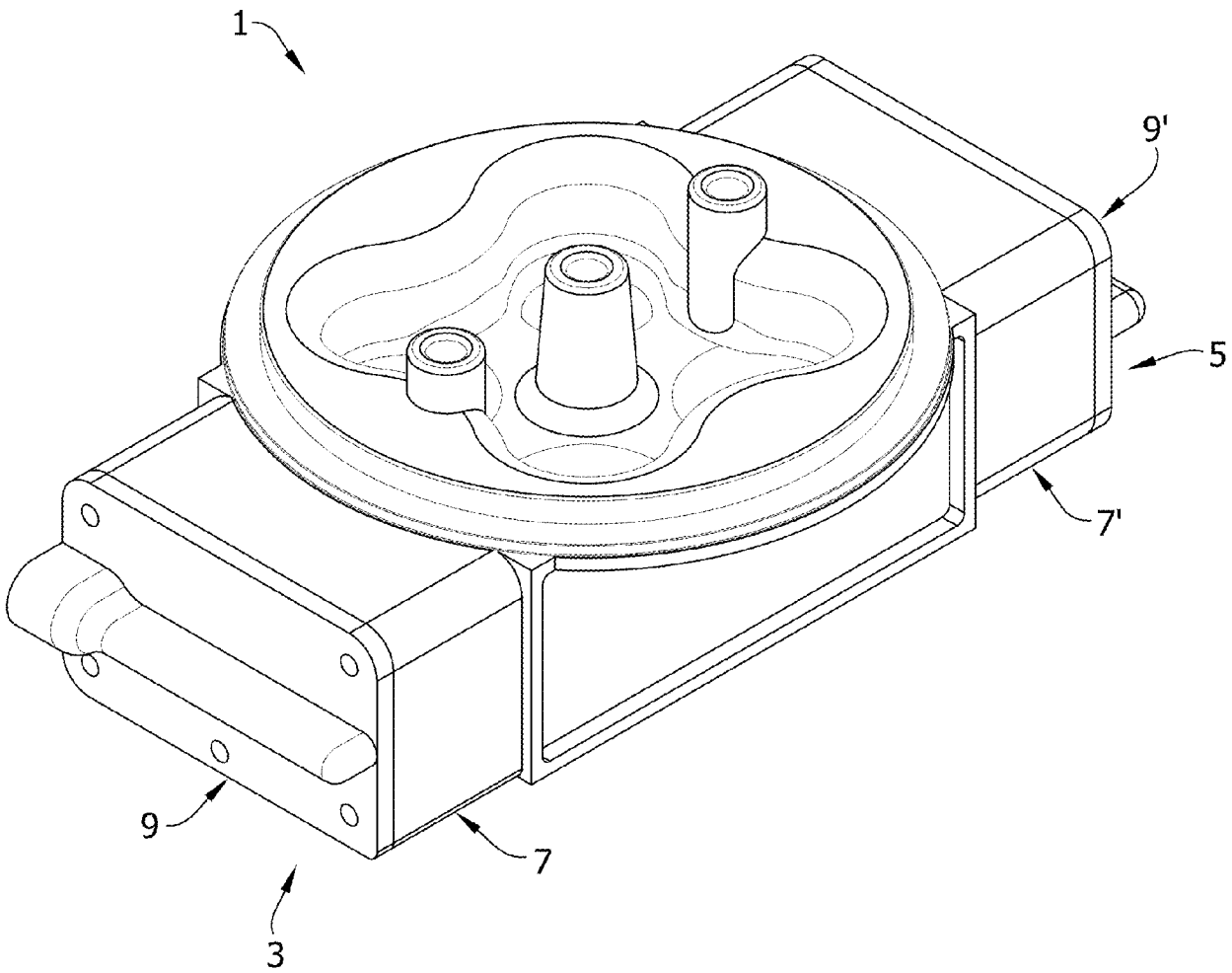
FIG. 1 is a perspective of a carburetor including primary and secondary fuel bowls.
Figure 2:
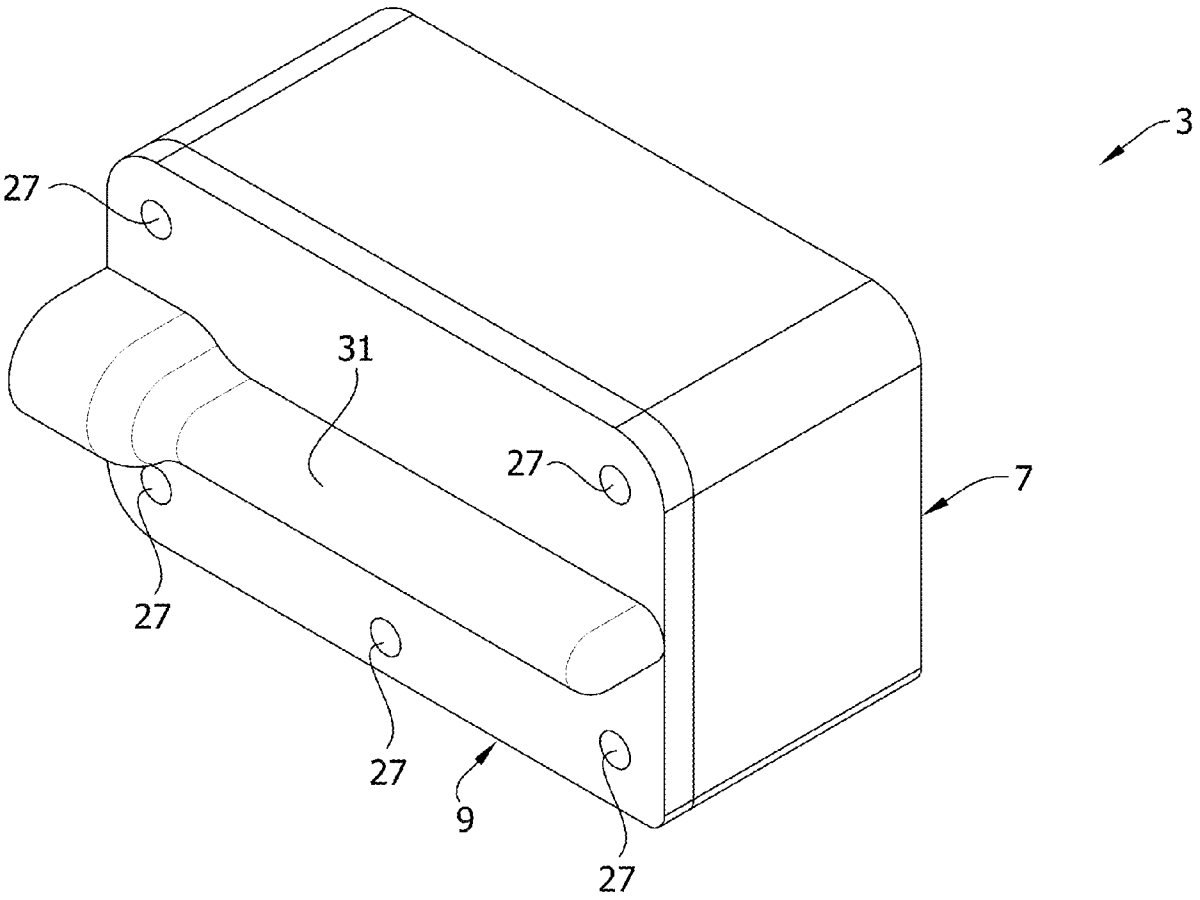
FIG. 2 is a perspective of the primary fuel bowl.

Referring now to the drawings and in particular to FIG. 1, a carburetor constructed according to the principles of the present invention is generally indicated at 1. The carburetor includes a primary fuel bowl 3 and a secondary fuel bowl 5 from which fuel is drawn to mix with air for feeding into an engine (not shown). The fuel bowls 3, 5 are mounted on a meter block 6 of the carburetor 1. The illustrated carburetor is a four barrel carburetor of the type used on a vehicle, but can be any type of carburetor used for any type of gasoline engine. The present invention has particular application for high-performance engines of the type used in stock car racing. These engines can develop power on the order of 800 h.p. and therefore can have high fuel demand, particularly upon acceleration. It has been discovered that conventional fuel bowls are inadequate to feed enough fuel in certain conditions.

Figure 3:
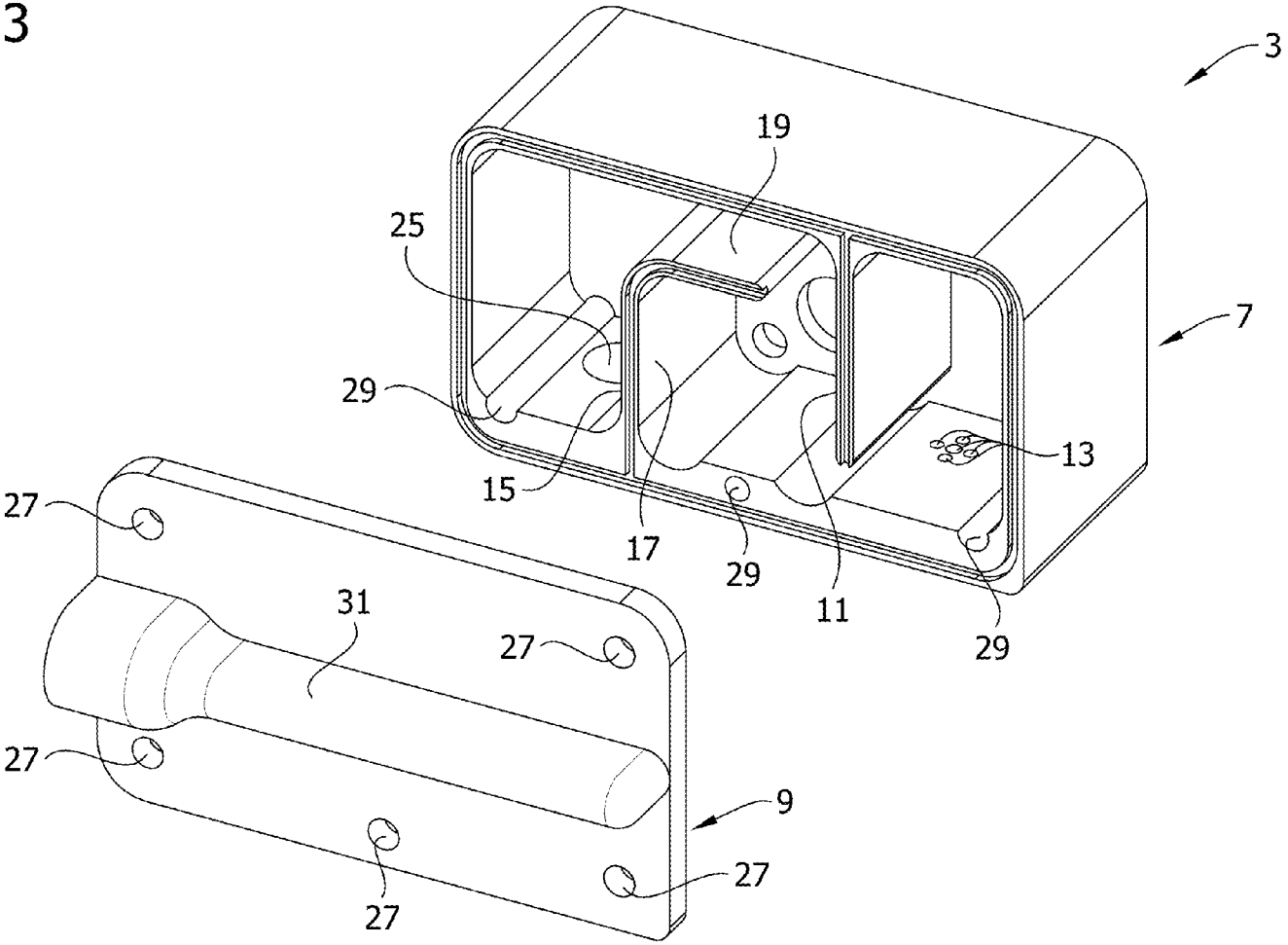
FIG. 3 is the perspective of FIG. 2 with a front plate of the primary fuel bowl exploded from the fuel bowl.
Figure 4:
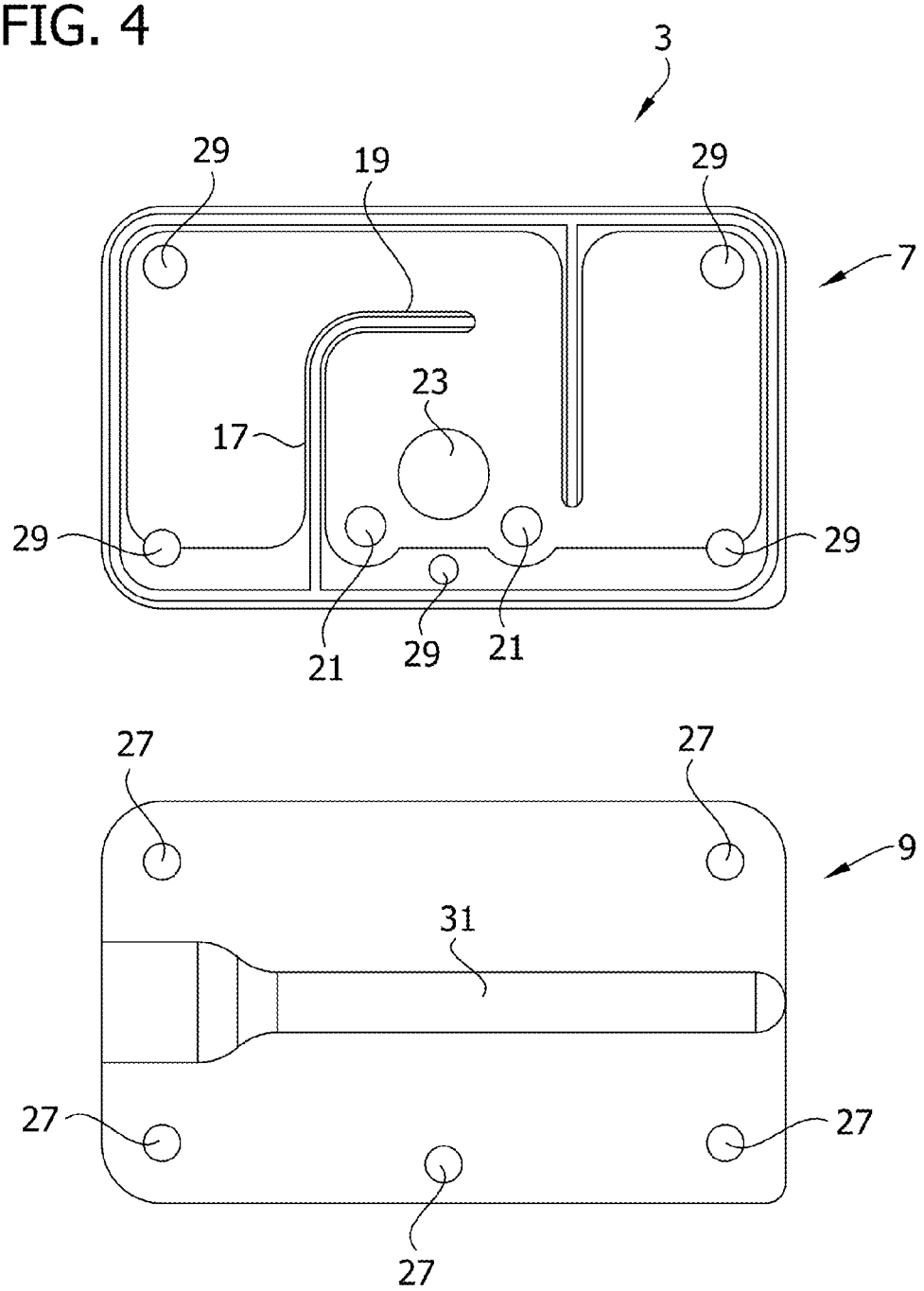
FIG. 4 is a front elevation of the primary fuel bowl with the front plate removed and below the remainder of the fuel bowl.

The fuel bowls 3, 5 of the carburetor 1 embody a novel constant fuel flow configuration that replaces conventional float valve fuel bowls and addresses the foregoing problems. Referring to FIGS. 2-7, the primary fuel bowl 3 is shown to comprise a fuel container 7 and a removable front plate 9. Together, the container 7 and front plate 9 are considered the body of the fuel bowl. In FIGS. 3 and 4, the front plate 9 is removed from the container 7 to show internal construction of the container, but would in operation sealingly close the container. The container 7 defines an internal cavity for containing fuel and includes three compartments all partially defined by top, bottom and back walls on the container, as well as the front plate 9. A first compartment on a right side of the container 7 is further defined between a partition 11 depending from a top wall of the container 7 and a right end wall of the container. The partition 11 extends from the top wall of the container 7 to a location short of the bottom wall of the container so that fuel entering the first compartment can pass under the partition 11 to a second compartment in a center of the container. Holes 13 in the bottom wall of the container 7 located within the first compartment allow fuel to be drawn by an accelerator pump (not shown) in a suitable manner understood by those of ordinary skill in the art.

The second compartment is further defined on one side by the partition 11 and the other side by a weir 15. In this embodiment, the second compartment or the combination of the first and second compartment may be considered a "reservoir compartment." The weir 15 includes a first portion 17 projecting up from the bottom wall of the container 7 and a second portion 19 extending horizontally from the first portion toward the partition 11 and spaced from both the top and bottom walls of the container. It will be understood that the first portion 17 and second portion 19 may have other than orthogonal relationships with each other and/or with the walls of the container 7 within the scope of the present invention. The partition 11 and the weir 15 are sealed with the back wall and with the inner face of the front plate 9, when it is attached to the container. Fuel may pass from the second compartment to a third or recirculation compartment through a compartment opening defined between a free end of the second portion 19 of the weir 15 and the partition 11. It will be understood that the compartment opening could be formed in other ways, such as by extending the second portion 19 of the weir 15 all the way to the partition 11 and then providing one or more openings in the second portion or otherwise providing a restricted path around the weir 15. The weir 15 facilitates maintenance of a constant fuel level in the second compartment, as will be described more fully hereinafter. The back wall of the container includes two jet openings 21, through which fuel is aspirated into the meter block 6 of the carburetor 1, and a power valve opening 23. The jet openings 21 may be considered "fuel supply outlets" of the fuel bowl 3.

Figure 5:
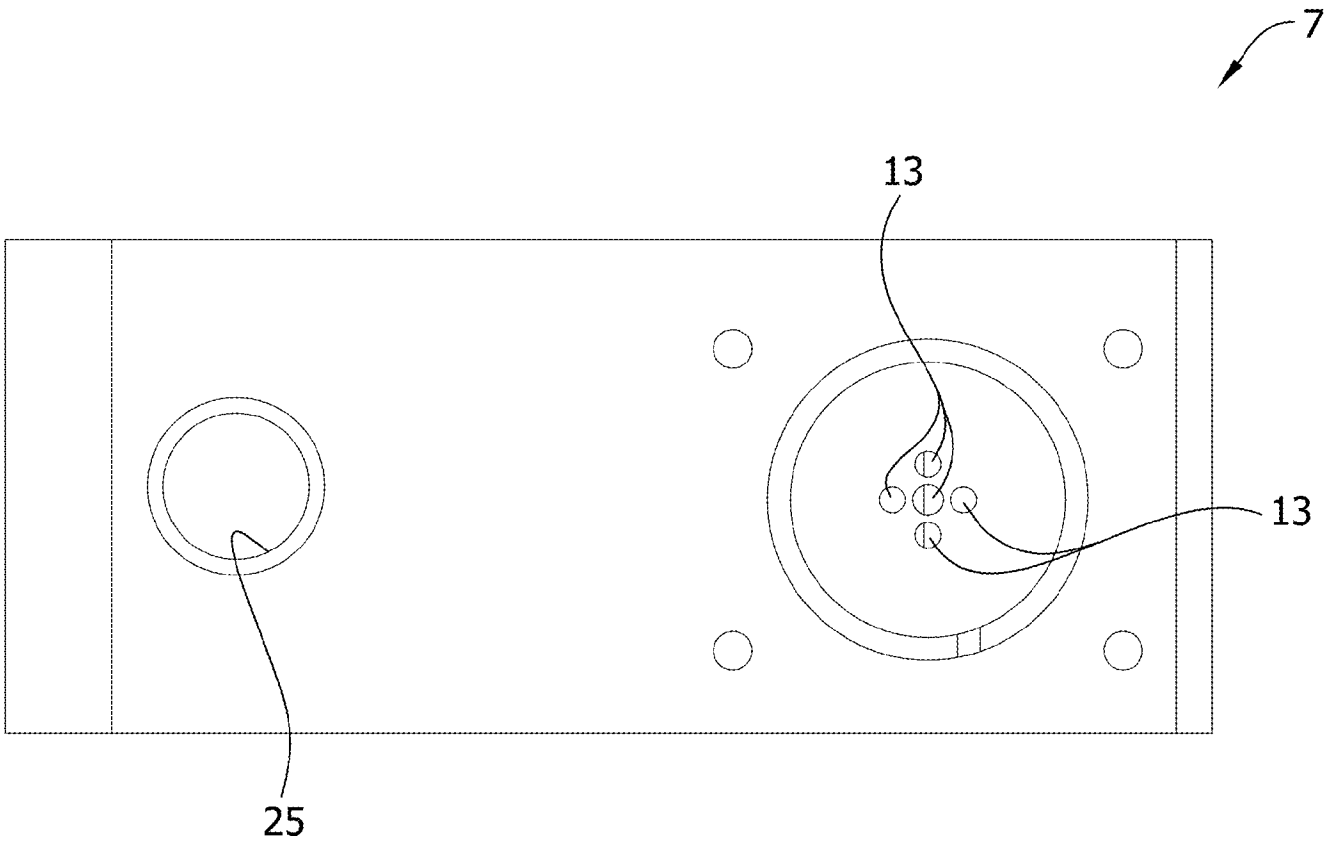
FIG. 5 is a bottom plan view of a container of the primary fuel bowl.
Figure 6:
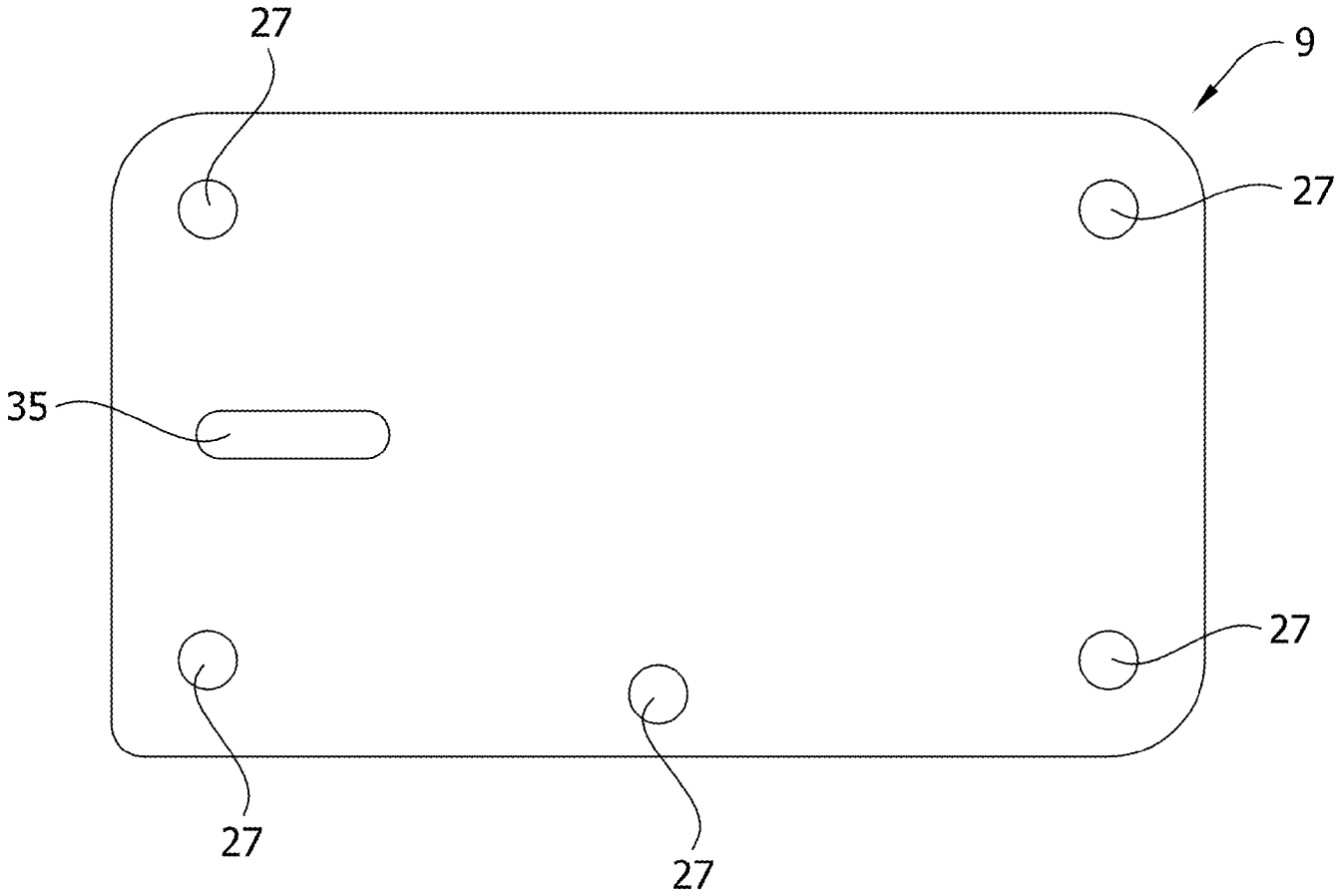
FIG. 6 is a back side elevation of the front plate of the primary fuel bowl.
Figure 7:
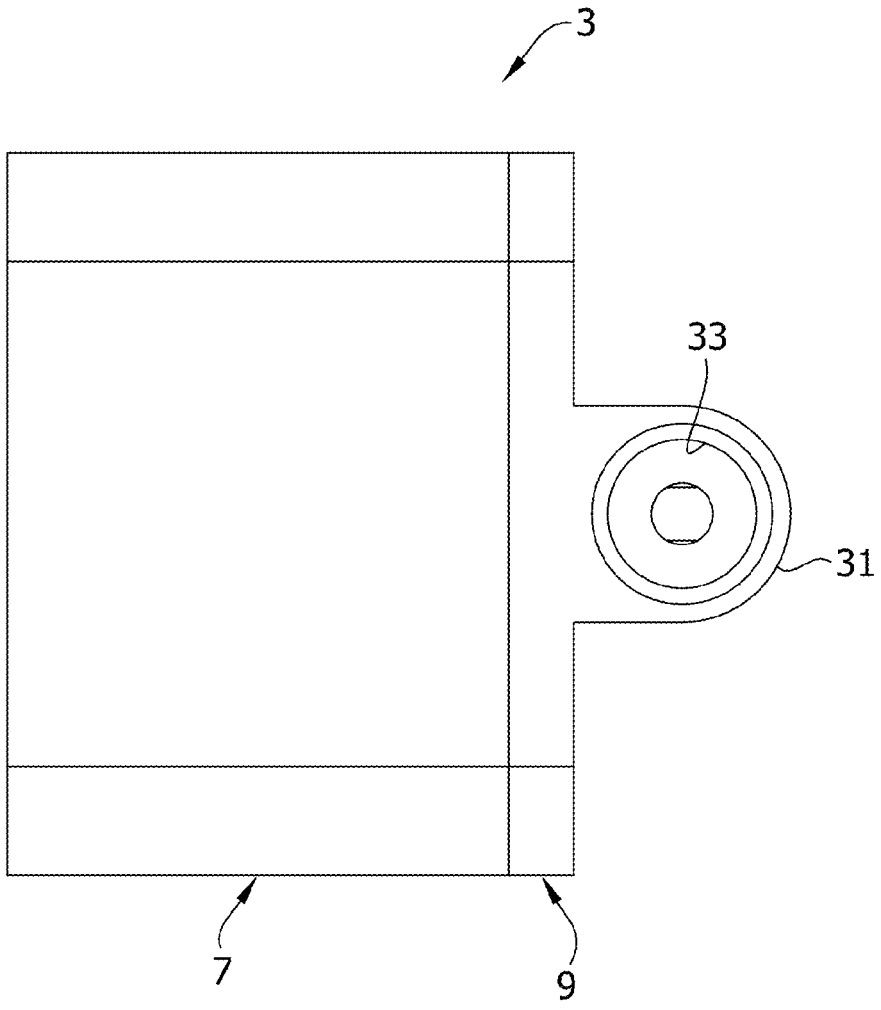
FIG. 7 is a left end view of the primary fuel bowl.

The third compartment of the container 7, located on the left side as seen in FIGS. 3 and 4, is further defined by the weir 15 and a left side wall of the container 7. As shown in FIGS. 3 and 5, a recirculation outlet 25 in the bottom wall of the container 7 is located in the third compartment and permits fuel to exit the fuel bowl 3 and return to a fuel tank (not shown). The front plate 9 can be attached to the container 7 by bolts (not shown) received through openings 27 located in the front plate and openings 29 located in the container. As attached to the container 7, the front plate 9 seals an open front of the container. Suitable sealing material may be used at the engaging surfaces of the container 7 and the front plate 9 to promote sealing. More particularly, the front plate 9 seals all around the perimeter of the front of the container 7, and also seals with the front edges of the partition 11 and the weir 15. The front plate 9 is formed with a fuel intake passage 31 including an inlet 33 (FIG. 7) that can be connected to a fuel supply line (not shown). Any of a set of orifice pieces (not shown) may be removably received in the inlet 33 as a coarse control of fuel intake into the fuel bowl 3. As may be seen in FIG. 6, the fuel intake passage 31 opens on the back side of the front plate 9 through an outlet 35. As attached to the container 7, the outlet 35 of the fuel intake passage 31 opens into the first compartment of the container. The fuel bowl 3 is configured to restrict the flow of fuel within the internal cavity of the fuel bowl between the outlet 35 and the recirculation hole 25. More specifically, the partition 11 and the weir 15 restrict the flow of fuel within the internal cavity, as described more fully hereinafter.

Figure 8:
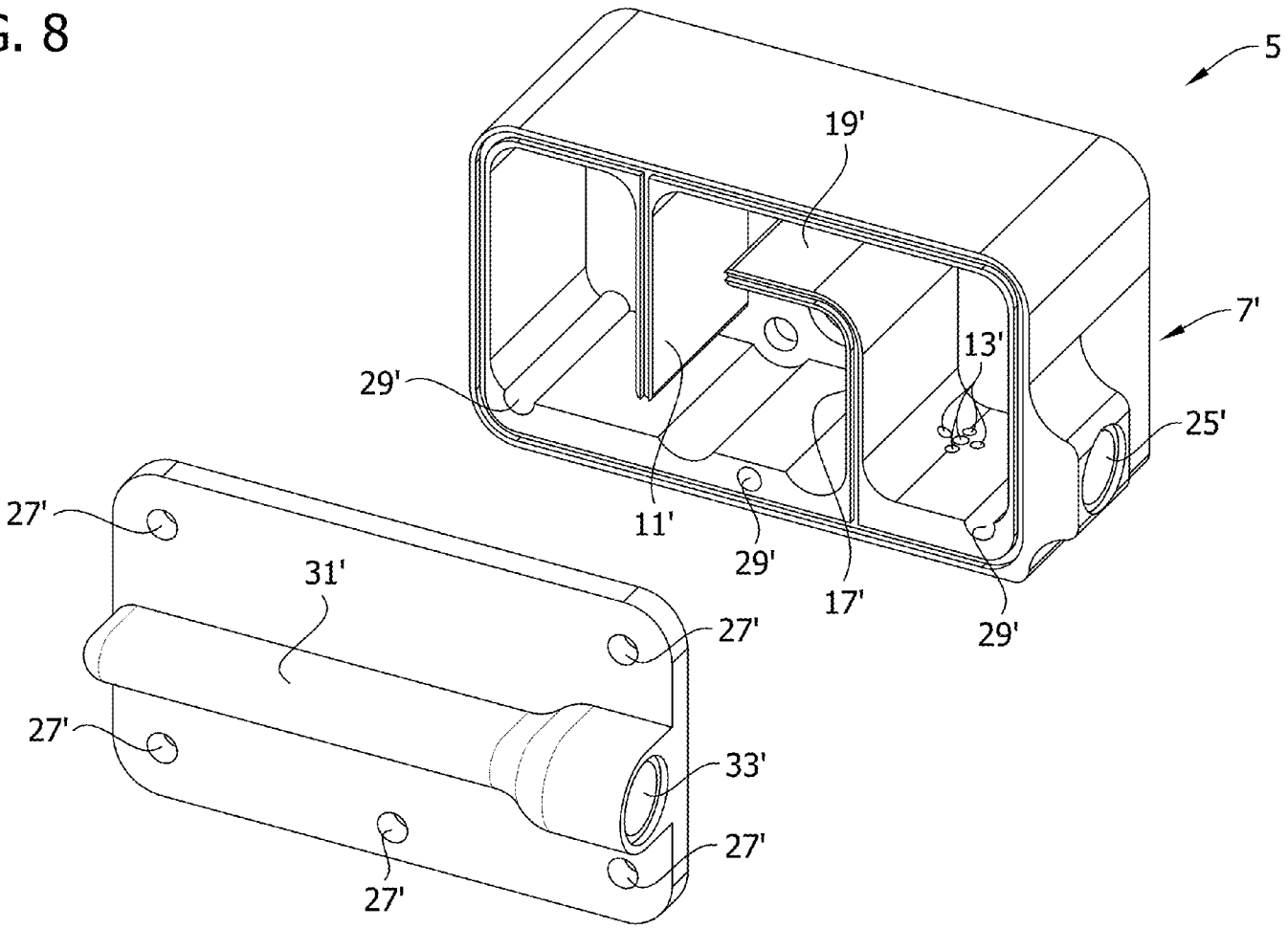
FIG. 8 is a perspective of the secondary fuel bowl with a front plate of the secondary fuel bowl exploded from the remainder of the fuel bowl.

The secondary fuel bowl 5 is shown in FIG. 8. The construction of the secondary fuel bowl 5 is the same as for the primary fuel bowl 3, except as noted hereinafter. Therefore, corresponding reference numerals will be used to designate corresponding parts with the addition of a trailing prime to denote that the parts belong to the secondary fuel bowl 5. In general, the interior of the container 7' is a mirror image of the interior of the container 7 of the primary fuel bowl, including partition 11' and weir 15'. One difference is that the holes 13' for fuel to the accelerator pump are located in the third compartment, rather than in the first compartment. Further, recirculation outlet 25' is located in the right side wall of the secondary fuel bowl container 7', rather than in the bottom wall, as with the primary fuel bowl 3. For use with a four barrel carburetor, both the primary and secondary fuel bowls 3, 5 would be provided. In addition, lines and fittings (not shown) for connecting the inlet 33, 33' to a single fuel pump line, and the recirculation outlets 25, 25' to a single fuel tank return line may be provided with the fuel bowls 3, 5.

Having described the construction of the primary and secondary fuel bowls 3, 5, their operation will be described. More specifically, the operation of the primary fuel bowl 3 will be described which will suffice for a description of the operation of the secondary fuel bowl. Fuel is delivered by a fuel pump through a fuel line to the inlet 33 of the fuel intake passage 31. In a preferred embodiment, fuel is delivered substantially continuously during engine operation into the primary fuel bowl 3. In the preferred embodiment, there is no valve associated with the fuel bowl to shut off the flow of fuel between the outlet 35 of the intake passage 31 and the recirculation outlet 25. Fuel exits the fuel intake passage 31 through the outlet 35 and enters the first compartment about midway up the height of the first compartment. Liquid fuel falls toward the bottom wall of the container 7 and under the partition 11 into the second compartment. Foamed fuel formed upon the rapid entry of fuel through the outlet 35 into the first compartment is blocked from entering the second compartment by the partition 11 and by the liquid fuel at the bottom of the first compartment. Thus, undesirable foaming is kept out of the second compartment from which the carburetor 1 draws fuel, as will be described.

Liquid fuel continues to flow under the partition 11 and into the second compartment, filling the second compartment up to the second portion 19 of the weir 15. Excess fuel in the second compartment moves between the free end of the second portion 19 and the partition 11, overflowing the weir 15 and passing into the third compartment. Fuel in the third compartment is drawn out of the primary fuel bowl 3 through the recirculation outlet 25 where it passes back to the fuel tank. The fuel can be again pumped (recirculated) into the fuel bowl 3. It will be understood that there is a continuous flow of fuel through the fuel bowl 3 during operation of the engine. There is no valve or other mechanism in the primary fuel bowl 3 for stopping and starting the flow of fuel into the fuel bowl. In one embodiment, fuel is circulated through the fuel bowl 3 at a rate of about 100 lbs/hr to about 300 lbs/hr.

As a result of the foregoing operation, the second compartment remains filled at all times with liquid fuel. The jet openings 21 and power valve opening 23 are always covered with fuel so that the full portion of fuel demanded by the carburetor 1 can be delivered at all times. Consider the situation where the vehicle is cornering to the left. In the orientation of the fuel bowl 3 shown in FIGS. 3 and 4, the inertia of the fuel tends to cause the fuel to move to the left within the second compartment. The weir 15 and in particular the overhanging second portion 19 of the weir inhibits flow of fuel out of the second compartment. Moreover, the constant flow of fuel at a high rate through the fuel bowl 3 maintains the second compartment in a filled state under the inertial conditions just described as well as when combined with large fuel demands from a high-performance engine. Thus, the jet openings 21 and the power valve opening 23 remain covered with fuel during cornering so no portion, and in particular the right jet opening, is starved for fuel. Regardless of the movement of the fuel within the fuel bowl 3, the weir 15 and partition 11 facilitate maintaining the second compartment full of fuel. For example, it has been found that the second compartment remains substantially full even when the fuel bowl 3 is turned to lie on the front plate 9, which would not be encountered in normal use.

Figure 9:
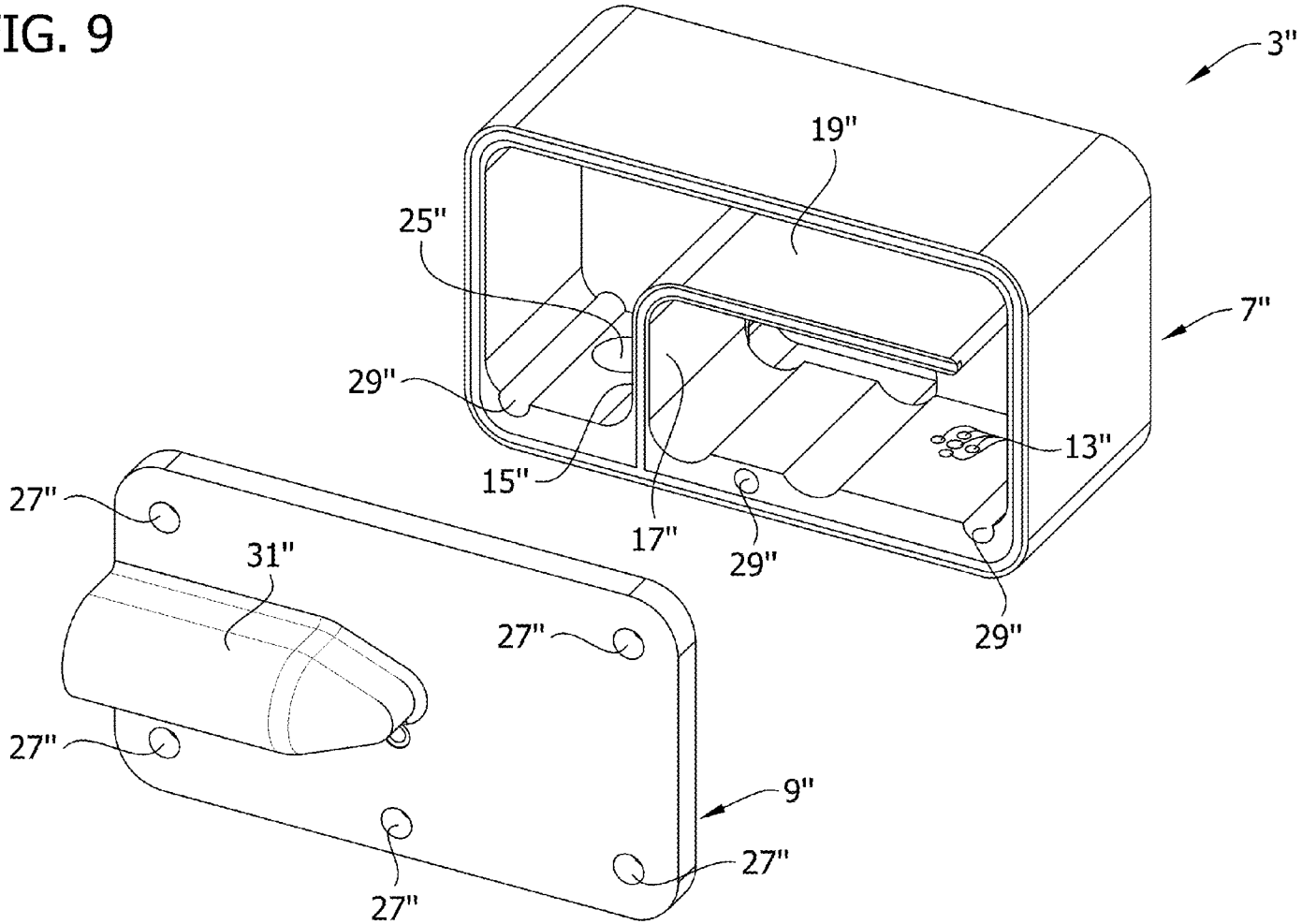
FIG. 9 is a perspective of a primary fuel bowl of a second embodiment, with a front plate exploded from the fuel bowl.
Figure 10:
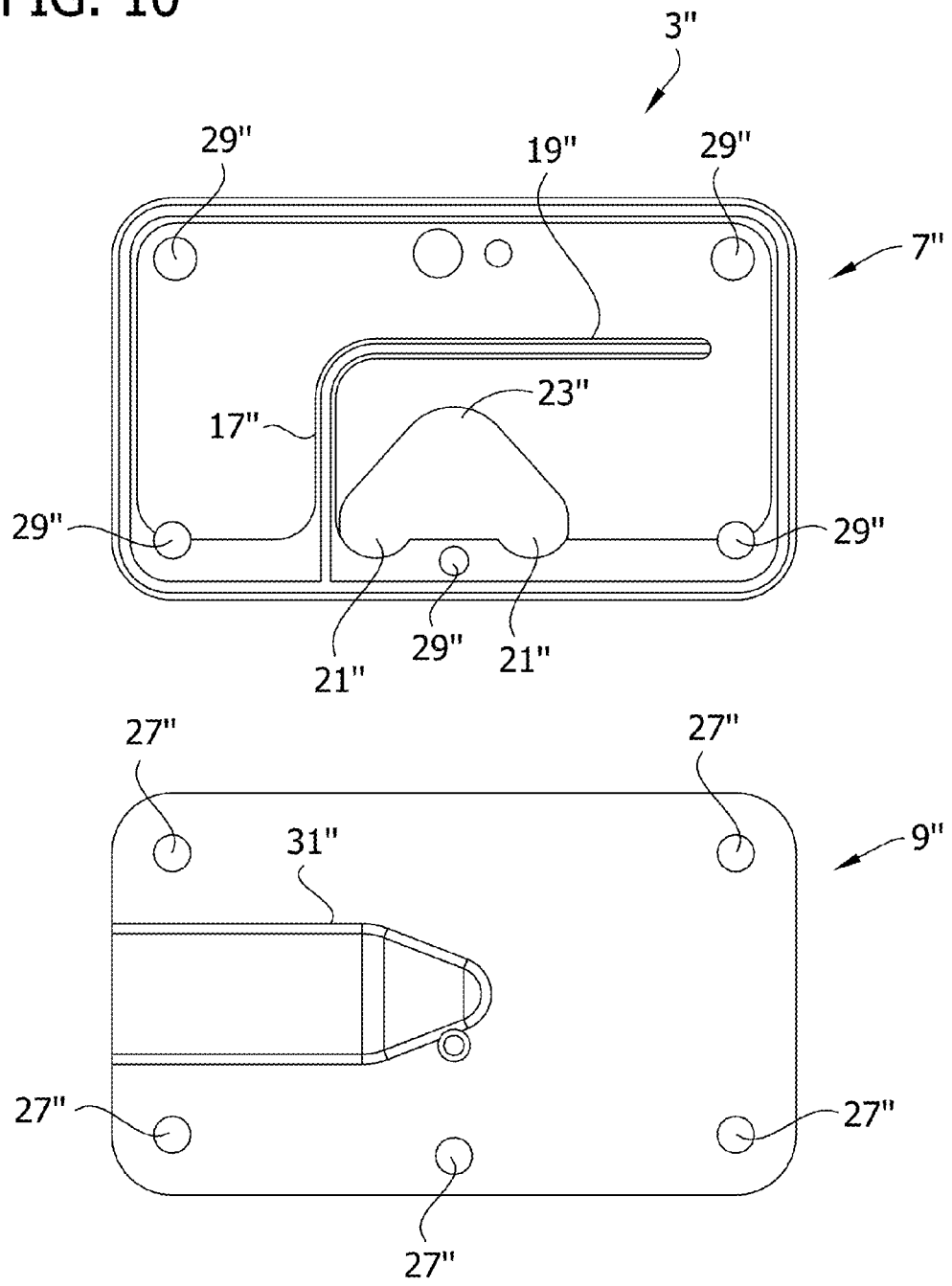
FIG. 10 is a front elevation of the primary fuel bowl of FIG. 9 with the front plate removed and below the remainder of the fuel bowl.

Referring now to FIGS. 9 and 10, a primary fuel bowl of a second embodiment is indicated generally at 103. The construction of the fuel bowl 103 is generally similar to the construction of the fuel bowl 3, and corresponding parts will be given the same reference numeral with the addition of one hundred. The fuel bowl 103 is shown to comprise a fuel container 107 and a removable front plate 109. The front plate 109 is removed from the container 107 to show internal construction of the container, but would in operation sealingly close the container. The container 107 defines an internal cavity for containing fuel and includes two compartments each partially defined by top, bottom and back walls on the container, as well as the front plate 109. The fuel bowl 103 differs in one respect from the fuel bowl 3 in that there are two rather than three internal compartments. A first or reservoir compartment on a right side of the container 107 is further defined between a weir 115 projecting up from a bottom wall of the container 107 and a right end wall of the container. Holes 113 in the bottom wall of the container 107 located within the first compartment allow fuel to be drawn by an accelerator pump (not shown) in a suitable manner understood by those of ordinary skill in the art.

The weir 115 includes a first portion 117 projecting up from the bottom wall of the container 107 and a second portion 119 extending horizontally from the first portion toward the right wall of the container and spaced from both the top and bottom walls of the container. In the illustrated embodiment, the second portion 119 has a length which is greater than one half the distance between the left and right walls of the container 107. It will be understood that the first portion 117 and second portion 119 may have other than orthogonal relationships with each other and/or with the walls of the container 107 within the scope of the present invention. As may be seen by comparison to the fuel bowl 3, the fuel bowl 103 eliminates the partition 11 and extends the second portion 119 of the weir 115. The weir is sealed with the back wall of the container 107 and with the inner face of the front plate 109, when it is attached to the container. Thus, the weir 115 acts as a flow restrictor within the internal cavity of the fuel bowl 103. The only way fuel passes from the first compartment to a second or recirculation compartment is through a compartment opening between the free end of the second portion 119 and the right wall of the container 107. It will be understood that the compartment opening could be formed in other ways, such as by extending the second portion 119 of the weir 115 all the way to the right wall of the container 107 and then providing one or more openings in the second portion, or otherwise providing a restricted path around the weir 115. The weir facilitates maintenance of a constant fuel level in the first compartment, as will be described more fully hereinafter. A back wall of the container 107 has a generally triangular opening including two jet opening portions 121 through which fuel is aspirated into the carburetor 1 and a power valve opening portion 123. In use, the back wall of the container 107 butts against and seals with the meter block 6 (FIG. 1) of the carburetor 1. The triangular opening including portions 121 and 123 allows the fuel bowl 103 to mate with carburetors that have different spacings of ports for the jets and the power valve.

The second or recirculation compartment of the container 107, located above and on the left side as seen in FIGS. 9 and 10, is further defined by the weir 115, the top wall, the bottom wall and a left side wall of the container, in addition to the back wall and the inner surface of the front plate 109. As shown in FIG. 9, a recirculation outlet 125 in the bottom wall of the container 107 is located in the second compartment and permits fuel to exit the fuel bowl 103 and return to the fuel tank (not shown). The second compartment allows for overflow from the first compartment, while allowing the first compartment to remain substantially full under all types of engine demand for fuel. A vent opening 126 in the back wall of the container 107 within the second compartment is provided. A vent pipe (not shown) may be attached to the container 107 on the outside of the back wall using a fastener received in an opening 130 in the back wall.

As with the first embodiment of the fuel bowl 3, the front plate 109 of the fuel bowl 103 can be attached to the container 107 by bolts (not shown) received through openings 127 located in the front plate and openings 129 located in the container. As attached to the container 107, the front plate 109 seals an open front of the container. Suitable sealing material may be used at the engaging surfaces of the container 107 and the front plate 109 to promote sealing. More particularly, the front plate 109 seals all around the perimeter of the front of the container 107, and also seals with the front edge of the weir 115. The front plate 109 is formed with a fuel intake passage 131 including an inlet (not shown, but similar to FIG. 7) that can be connected to a fuel supply line (not shown). In a preferred embodiment the fuel intake passage 131 is sized or has an appropriate restrictor so that the fuel bowl 103 can be used with all types of engines having a range of fuel demands. The fuel intake passage 131 opens on the back side of the front plate 109 (such as through an outlet, similar to FIG. 6). As attached to the container 107, the outlet of the fuel intake passage 131 opens into the first compartment of the container at a location opposite the jet portions 121 and power valve portions 123 of the triangular opening. The relatively large size of the first compartment of the fuel bowl 103 allows a substantial amount of fuel to be contained in the compartment so that demands on the pump pushing fuel through the fuel bowl 103 are significantly moderated even in situations where there is a high demand for fuel. A secondary fuel bowl (not shown) may also be provided. It would have an internal structure mirroring that of the primary fuel bowl 103 with the accelerator pump holes 113 re-located to the second compartment and fuel recirculating hole 125 in the left side wall, similar to secondary fuel bowl 5.

In operation, fuel is delivered by the fuel pump through the fuel line to the fuel intake passage 31. In a preferred embodiment, fuel is delivered substantially continuously during engine operation into the primary fuel bowl 103. In the preferred embodiment, there is no valve associated with the fuel bowl 103 to shut off the flow of fuel from the intake passage 131 to the recirculation hole 125. Fuel exits the fuel intake passage 131 into the first compartment near the top of the first compartment and almost directly across from the triangular opening including the jet opening portions 121 and the power valve portion 123. Liquid fuel fills the first compartment from which fuel can be drawn off through the jet opening portions 121, power valve portion 123 and accelerator pump holes 113 as demanded. Any excess fuel beyond what is demanded from the fuel bowl 103 by the engine can flow past the edge of the second portion 119 of the weir 115 into the second compartment. Once in the second compartment, the fuel can exit the fuel bowl 103 through recirculation outlet 125 back to a reservoir (e.g., the fuel tank) in fluid communication with the fuel pump for being circulated through the fuel bowl 103 again. As with the fuel bowl 3, it will be understood that there is a continuous flow of fuel through the fuel bowl 103 during operation of the engine. There is no valve or other mechanism in the primary fuel bowl 103 for stopping and starting the flow of fuel into the fuel bowl. In one embodiment, fuel is circulated through the fuel bowl 3 at a rate of about 100 lbs/hr to about 300 lbs/hr.

As a result of the foregoing operation, the first compartment remains filled at all times with liquid fuel. The jet opening portions 121 and power valve opening portion 123 are always covered with fuel so that the full portion of fuel demanded by the carburetor 1 can be delivered at all times. The fuel bowl 103 is arranged so that when the vehicle is cornering to the left (as is always the case in racing), the inertia of the fuel tends to cause the fuel to move to the left as the fuel bowl is oriented in FIGS. 9 and 10. The weir 115 prevents too much fuel from overflowing the weir and undesirably emptying the first compartment. Thus, the first compartment remains full in cornering and the jet opening portions 121 and power valve opening portion 123 remain fully covered by the fuel in that condition. As a result, no part of the engine is starved for fuel in cornering. Similar results occur for acceleration, in which case the inertia of the fuel would cause it to move toward the back wall of the container 107. The second portion 119 of the weir 115 holds the fuel in the first compartment as it tries to move toward the back wall. While these are the most common inertial movements of the fuel encountered, it has been found that the weir 115, in combination with the constant flow of fuel into the container 107 from the passage 131 is able to keep the first compartment full and the jet opening portions 121 covered for best engine performance no matter which way the fuel bowl 103 is tipped from its horizontal position.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A fuel bowl for holding liquid fuel to be fed into a carburetor for an internal combustion engine, the fuel bowl comprising a body having an internal cavity and a back wall partially defining the internal cavity configured for interfacing with a meter block of the carburetor, the back wall having a thickness, a bottom end, a top end, and a height extending between the bottom end and the top end, a fuel inlet configured to receive fuel from a fuel tank into the cavity, a recirculation outlet configured to pass fuel from the internal cavity back to the fuel tank and a fuel supply outlet configured for mating with a carburetor fuel inlet for passing liquid fuel from the cavity to the carburetor, the fuel supply outlet extending from an opening facing the internal cavity through the thickness of the back wall, said opening being spaced apart between the top end and the bottom end of the back wall, the body being free of valving whereby fuel can be circulated continuously through the cavity to maintain a fuel level in the internal cavity above said opening of the fuel supply outlet.

2. The fuel bowl as set forth in claim 1 wherein the body is configured to restrict the flow of fuel within the internal cavity from the fuel inlet to the recirculation outlet.

3. The fuel bowl as set forth in claim 2 wherein the body further comprises a weir in the cavity interposed between the fuel inlet and the recirculation outlet.

4. The fuel bowl as set forth in claim 3 wherein the weir defines a reservoir compartment and a recirculation compartment within the internal cavity, the fuel supply outlet being located in the reservoir compartment and the recirculation outlet being located in the recirculation compartment.

5. The fuel bowl as set forth in claim 4 further comprising an accelerator pump outlet in the body located in the reservoir compartment.

6. The fuel bowl as set forth in claim 4 wherein the weir comprises a first portion projecting upwardly from a bottom of the cavity.

7. The fuel bowl as set forth in claim 6 wherein the weir includes a free end spaced from the body within the internal cavity and at least partially defining a compartment opening communicating with the reservoir compartment and the recirculation compartment, the weir being configured to block flow of fuel from the reservoir compartment to the recirculation compartment except through the compartment opening.

8. The fuel bowl as set forth in claim 7 wherein the weir comprises a second portion projecting transversely of the first portion, the free end of the weir being on the second portion.

9. The fuel bowl as set forth in claim 8 wherein the second portion of the weir extends generally horizontally within the fuel bowl.

10. The fuel bowl as set forth in claim 8 wherein the second portion of the weir extends a length that is at least half the width of the cavity.

11. The fuel bowl as set forth in claim 1 wherein the body has a vent opening therein.

12. The fuel bowl as set forth in claim 1 in combination with a secondary fuel bowl.

13. The fuel bowl as set forth in claim 1 further comprising at least one mounting hole for receiving a fastener for mounting the fuel bowl on the carburetor.

14. The fuel bowl as set forth in claim 13 wherein the mounting hole extends through the thickness of the back wall.

15. The fuel bowl as set forth in claim 4 further comprising a power valve opening in communication with the reservoir chamber and extending from a location spaced apart between the top end and the bottom end of the back wall through the thickness of the back wall.

16. A fuel bowl for holding liquid fuel to be fed into a carburetor for an internal combustion engine, the fuel bowl comprising a body having an internal cavity, a fuel inlet configured to receive fuel from a fuel tank into the cavity, a recirculation outlet configured to pass fuel from the internal cavity back to the fuel tank and a fuel supply outlet configured for mating with a carburetor fuel inlet for passing liquid fuel from the cavity to the carburetor, and a flow restrictor in the cavity arranged between the fuel supply outlet and the recirculation outlet for retaining fuel in a volume including the fuel supply outlet;

wherein the flow restrictor comprises a weir and the weir defines a reservoir compartment and a recirculation compartment within the internal cavity, the fuel supply outlet being located in the reservoir compartment and the recirculation outlet being located in the recirculation compartment, the weir comprising a first portion projecting upwardly from a bottom of the cavity and a second portion projecting transversely of the first portion and defining a free end of the weir spaced from the body within the cavity and defining a compartment opening communicating with the reservoir compartment and the recirculation compartment, the weir being configured to block flow of fuel from the reservoir compartment to the recirculation compartment except through the compartment opening.

17. The fuel bowl as set forth in claim 16 in combination with a secondary fuel bowl.

18. A method of feeding liquid fuel to a carburetor of an internal combustion engine comprising:

continuously circulating liquid fuel through a fuel bowl;

constraining fuel within the fuel bowl to maintain a volume of fuel in a reservoir compartment of the fuel bowl including a fuel supply outlet connected to the carburetor through which liquid fuel from the fuel bowl is drawn into the carburetor;

wherein the step of continuously circulating comprises directing the fuel upward over a weir comprising a first portion projecting upwardly from a bottom of the fuel bowl and a second transverse portion projecting transversely of the first portion, the weir defining the reservoir compartment, and subsequently directing the fuel transversely over the second transverse portion of the weir into a recirculation compartment of the fuel bowl.

* * * * *